United States Patent [19]

Horiuchi et al.

[11] 4,129,442

[45] Dec. 12, 1978

[54] WEAR- AND IMPACT-RESISTING CAST STEEL

[75] Inventors: Kaoru Horiuchi, Toride; Akio Matsui, Chiba; Masahiro Hara, Sakura; Hiroshi Takahashi, Funabashi, all of Japan

[73] Assignee: Kawasaki Jukogyo Kabushiki Kaisha, Kobe, Japan

[21] Appl. No.: 787,492

[22] Filed: Apr. 14, 1977

Related U.S. Application Data

[63] Continuation-in-part of Ser. No. 756,629, Jan. 4, 1977, abandoned.

[30] Foreign Application Priority Data

Jan. 14, 1976 [JP] Japan ..... 51-3331

[51] Int. Cl.[2] ..... C22C 38/28

[52] U.S. Cl. ..... 75/126 C; 75/126 D; 75/126 F; 75/126 Q

[58] Field of Search ..... 75/126 Q, 126 D, 126 F, 75/126 C; 148/36

[56] References Cited

U.S. PATENT DOCUMENTS

| | | | |
|---|---|---|---|
| 3,044,872 | 7/1962 | Hayes et al. | 75/126 F |
| 3,574,602 | 4/1971 | Gondo et al. | 75/126 F |
| 3,973,951 | 8/1976 | Satsumabayashi | 148/36 |

FOREIGN PATENT DOCUMENTS

| | | | |
|---|---|---|---|
| 1051014 | 1954 | France | 75/126 F |
| 47-9901 | 8/1968 | Japan | 148/36 |
| 46-22327 | 6/1971 | Japan | 75/126 D |
| 46-40848 | 12/1971 | Japan | 148/36 |

*Primary Examiner*—Arthur J. Steiner

*Attorney, Agent, or Firm*—Lane, Aitken, Dunner & Ziems

[57] ABSTRACT

A low alloy cast steel consisting essentially of from 0.20 to 0.35% by weight of carbon, from 1.30 to 2.80% by weight of silicon, from 0.50 to 1.50% by weight of manganese, from 3.00 to 4.50% by weight of chromium, from 0.10 to 0.50% by weight of molybdenum, at least one element selected from titanium and zirconium, the sum of the titanium content and/or the zirconium content being between 0.03 and 0.10% by weight, and the balance essentially iron, has excellent mechanical properties, i.e., a hardness of Rockwell c 50 or higher and an impact value of 4 kg-m/cm$^2$ or higher while being devoid of a rock-candy fracture due to the presence of aluminium nitride.

1 Claim, No Drawings

WEAR- AND IMPACT-RESISTING CAST STEEL

CROSS REFERENCE TO RELATED APPLICATION

The present application is a continuation-in-part of U.S. application Ser. No. 756,629, now abandoned filed Jan. 4, 1977 and entitled WEAR- AND IMPACT-RESISTING CAST STEEL. The priority of Japanese Application No. 3331/1976, filed Jan. 14, 1976 is also claimed.

BACKGROUND OF THE INVENTION

This invention relates to a low alloy cast steel which affords extremely high wear- and impact-resisting properties and also relates to a process for producing the low alloy cast steel.

Cast steel parts as used in machines and equipments in the mining, civil engineering and cement industries should afford excellent wear- and impact-resisting properties.

Hitherto, wear resisting cast steel parts have been made of high-chromium cast iron, high-manganese cast steel, high chromium cast steel, low alloy cast steel and the like. However, there is not known a cast steel which provides excellent toughness and wear-resisting property at the same time, so that the aforesaid cast steels must have selectively been used according to requirement.

Low alloy cast steels, however, provide relatively well balanced toughness and wear resisting property. High manganese cast steel may be comparable to the low alloy cast steel, because of its toughness 10 times as high as that of a low alloy cast steel, although the wear resistance thereof remains only two thirds of the low alloy cast steel. Thus, it has, for long time, been a demand to provide a low alloy cast steel which has both high impact resisting property as is afforded by a high manganese cast steel, and wear-resistance twice that of a conventional low alloy cast steel, whereby a considerably wide range of application of high manganese cast steels may be substituted by that of such low alloy cast steels.

There is a relationship between impact values and hardness of a conventional low alloy cast steels which is well known to the skilled in the art. As can be known from the prior technology of the field, the low alloy cast steels having impact values of a range from 1.8 to 2.0 kg-m/cm$^2$ insure the freedom of a failure and thus are reliable in use. However, these are short of desired hardness and wear-resisting property. Hardness of Rockwell C 60 leads to improvements in wear-resisting property, but cause a failure sometimes. In short, low alloy cast steels having over hardness of Rockwell C 50 and an impact value of 4 kg-m/cm$^2$ provide desired wear-resisting property and toughness.

Meanwhile, our investigations concerning a cast steel have posed problem to be solved. More particularly, when the raw materials of the cast steel are melt in a low frequency induction furnace or the like, in case that a melting temperature is too high or the time held for melting is excessively long, such as a melting temperature over 1650° C. and a melting time of more than one hour, nitrogen gas is dissolved from the air into a melt in a great quantity, thereby producing aluminum nitride in the steel due to the reaction of nitrogen with aluminum contained in the steel. Aluminum nitride precipitates along primary cristal grain boundaries of a steel, upon solidification, thereby providing the so-called rock-candy fractures.

SUMMARY OF THE INVENTION

In accordance with the present invention, there is provided a cast steel consisting essentially of from 0.20 to 0.35% by weight of carbon, from 1.30 to 2.80% by weight of silicon, from 0.50 to 1.50% by weight of manganese, from 3.00 to 4.50% by weight of chromium, from 0.10 to 0.50% by weight of molybdenum, at least one element selected from titanium and zirconium, the sum of the titanium content and/or zirconium content being between 0.03 and 0.10% by weight, and the balance essentially iron. The present invention features the addition of at least one of elements titanium and zirconium, while the sum thereof is limited to a range from 0.03 to 0.10% by weight. The nitrides obtained due to reaction with the above enumerated elements will not precipitate along grain boundaries, unlike aluminum nitride, but is dispersed in a matrix and hence retains desired impact value.

It is therefore an object of the present invention to provide a wear- and impact-resisting low alloy cast steel which has a hardness of Rockwell C 50 or higher and an impact value of 4 kg-m/cm$^2$ or higher.

In view of another aspect, it is an object of the invention to provide a cast steel which is devoid of a rock-candy fracture due to the presence of aluminum nitride resulting from improper melting.

It is further object of the invention to provide a process for producing the above-mentioned cast steel.

DETAILED DESCRIPTION OF THE INVENTION

The following description will be given in the order of the progress of development of cast steels according to the present invention.

In the development project of cast steels according to the present invention, investigation and tests were given to the influences of alloying elements such as carbon (C), silicon (Si), chromium (Cr), molybdenum (Mo), manganese (Mn) and the like, and heat treatments applied thereto, on the hardness and toughness of cast steels, as well as on the influences of alloying elements such as titanium (Ti) zirconium (Zr) and the like on the prevention of a rock-candy fracture.

The results were summerized as follows:

(1) Carbon

In case the carbon level is no more than 0.2%, the resulting hardness is insufficient, irrespective of the addition of the other elements. In case the carbon level is no less than 0.35%, a desired impact value of 4 kg-m/cm$^2$ is not satisfied. The amount of carbon should range from 0.20% to 0.35%.

(2) Silicon

Silicon tends to shift low-temperature-tempering brittleness to a high temperature side, as well as chromium and molybdenium. An increase in content of silicon leads to lowering in hardness and impact value. More specifically, silicon level of no more than 1.30% fails to provide an impact value of 4 kg-m/cm$^2$. Likewise, the silicon level of no less than 2.80% fails to provide a desired impact value of 4 kg-m/cm$^2$. Thus, silicon should be present in amounts between 1.30 and 2.80%.

(3) Manganese

Manganese should be present in amounts no less than 0.5% for removal of impurities. As the amount of manganese is increased, the amount of residual austenite is increased along with an impact value, while the hardness is lowered. Thus, manganese should be present in amounts ranging from 0.50 to 1.50%.

(4) Chromium

The impact value resulting low temperature tempering is increased with an increase in content of chromium. In case the chromium level exceeds 5%, then the aforesaid impact value is lowered. Whereas, in case that the level of chromium is less than 3%, a hardness is not sufficient. The wear-resisting property is improved with an increase in amount of chromium. However, chromium should not be increased to over 4.5%. Thus, chromium should be present in amounts ranging from 3.0 to 4.5%.

(5) Molybdenum

Molybdenum improves hardenability of a steel and increases its strength. The target cast steel according to the present invention should provide relatively high temperature hardenability, so that molybdenum should be added in an amount of no less than 0.1% for increasing tempering-softening resistance, after high temperature hardening. The upper limit should be 0.5% from viewpoint of economy.

(6) Elements such as titanium

Titanium and zirconium have a stronger affinity for nitrogen than aluminium. Therefore, the addition of these elements prevent the formation of a rock-candy fracture due to aluminium nitride. For the prevention of a rock-candy fracture, titanium and/or zirconium should be present in the total amount of 0.03 to 0.10%. If its amount is too small, then there is lost an intended function or advantage, and if its amount is excessive, then other shortcomings result.

The invention will be particularly explained by way of the following examples, which should not be construed as limitation thereof.

EXAMPLE 1

Scraps of steel were charged to and melted in a low frequency induction furnace. Carbon, ferrosilicon and other elements were added to the molten to adjust its composition to that of the sample 1 as shown in the Table. After raising the temperature to over 1650° C., the molten was maintained thereat for further more than one hour. The molten steel was then poured into the ladle and inoculated with Fe-Ti. The resulting molten steel in the ladle was further poured into the mold to form a casting. The shaped casting was removed from the mold, was heated to a temperature of 950°–1080° C. and was maintained thereat, normally ½ hour/inch of the largest section thickness or diameter in order to accomplish uniform heating of the casting. Then the casting was subjected to drastically quenching and tempering at a temperature of 250° C. (The latter being a so-called "low temperature-tempering"). Five pieces as the sample 1 were cut down from the casting, and subjected to the test for determination of its impact value and hardness.

The average of the test results of the five pieces is shown in the below Table.

EXAMPLE 2–6

The samples 2–6 were produced by the same manner as the Example 1, except that each composition of these samples was adjusted to as shown in the Table. Zirconium was, when employed, added to the molten steel in the form of Fe-Zr prior to pouring to the mold as well as Fe-Ti. Likewise, five pieces of each sample were tested for determination of the impact value and hardness. The average of test results with regard to each sample is shown in the Table.

COMPARATIVE EXAMPLE

The sample 7 was produced and tested in the same manner as the preceding examples, except for no addition of titanium and zirconium, as shown in the Table.

Table 1

| Sample No. | Alloying element (%) C | Si | Mn | Cr | Mo | Ti | Zr | Total amount | HRC | Impact value (kg.m/cm²) |
|---|---|---|---|---|---|---|---|---|---|---|
| 1 | 0.32 | 1.80 | 0.62 | 3.23 | 0.34 | 0.08 | — | 0.08 | 53 | 4.7 |
| 2 | 0.30 | 1.53 | 1.30 | 3.55 | 0.35 | 0.06 | — | 0.06 | 53 | 4.9 |
| 3 | 0.26 | 1.95 | 1.13 | 3.70 | 0.33 | — | 0.10 | 0.10 | 50 | 5.1 |
| 4 | 0.30 | 1.70 | 1.10 | 4.03 | 0.29 | — | 0.06 | 0.06 | 51 | 4.6 |
| 5 | 0.28 | 2.10 | 0.95 | 3.90 | 0.33 | 0.04 | 0.04 | 0.08 | 51 | 5.4 |
| 6 | 0.25 | 1.49 | 0.98 | 3.96 | 0.25 | 0.04 | 0.02 | 0.06 | 52 | 5.5 |
| 7 (Comparison) | 0.29 | 1.60 | 1.31 | 4.10 | 0.32 | — | — | 0 | 50 | 3.5 |

The hardness is represented as Rockwell C, and the impact value is assessed by means of Charpy U-notch test. As is apparent from the above test results, in case that a melting temperature is too high and the time held for melting is excessively long as exampled in the Examples, the impact value is not sufficient for the practical use unless the cast steel contains titanium and zirconium. (The comparative sample No. 7)

It is apparently understood from the above results that the samples 1–6 according to the present invention can have the satisfying hardnesses and impact values even in such the severe conditions.

Namely, the present invention may effectively prevent the formation of a rock-candy fracture which is attributable to an improper melting procedure or operation and which results in lowering toughness, while achieving the intended hardness of Rockwell C 50 or higher and an impact value of 4 kg-m/cm$^2$ or higher. Thus, the cast steels according to the present invention may provide a wide range of applications in which high wear- and impact-resisting properties are required.

What is claimed is:

1. A wear- and impact-resisting cast steel characterized by a hardness of Rockwell C 50 or higher and an impact value of 4 kg-m/cm$^2$ or higher, said cast steel consisting essentially of from 0.20 to 0.35% by weight of carbon, from 1.30 to 2.80% by weight of silicon, from 0.50 to 1.50% by weight of manganese, from 3.00 to 4.50% by weight of chromium, from 0.10 to 0.50% by weight of molybdenum, at least one element selected from the group consisting of titanium and zirconium, the sum of said at least one element being between 0.03 and 0.10% by weight, and the balance essentially iron.

* * * * *